US008939117B2

(12) United States Patent
Yoshika et al.

(10) Patent No.: US 8,939,117 B2
(45) Date of Patent: Jan. 27, 2015

(54) VARIABLE VALVE ACTUATION DEVICE FOR INTERNAL COMBUSTION ENGINE

(75) Inventors: Daisuke Yoshika, Okazaki (JP); Ayatoshi Matsunaga, Okazaki (JP)

(73) Assignee: Mitsubishi Jidosha Kogyo Kabushiki Kaisha, Tokyo (JP)

( * ) Notice: Subject to any disclaimer, the term of this patent is extended or adjusted under 35 U.S.C. 154(b) by 140 days.

(21) Appl. No.: 13/393,011

(22) PCT Filed: Dec. 3, 2010

(86) PCT No.: PCT/JP2010/071666
§ 371 (c)(1),
(2), (4) Date: Feb. 28, 2012

(87) PCT Pub. No.: WO2011/070976
PCT Pub. Date: Jun. 16, 2011

(65) Prior Publication Data

US 2012/0152191 A1 Jun. 21, 2012

(30) Foreign Application Priority Data

Dec. 7, 2009 (JP) ..... 2009-277607

(51) Int. Cl.

| | |
|---|---|
| ***F01L 1/34*** | (2006.01) |
| ***F01L 1/344*** | (2006.01) |
| ***F01L 1/14*** | (2006.01) |
| ***F01L 1/053*** | (2006.01) |
| *F01L 1/047* | (2006.01) |

(52) U.S. Cl.
CPC ..... *F01L 1/3442* (2013.01); *F01L 1/143* (2013.01); *F01L 1/053* (2013.01); *F01L 2001/0473* (2013.01); *F01L 2001/0476* (2013.01); *F01L 2001/34483* (2013.01); *F01L 2103/02* (2013.01)
USPC ..... 123/90.17

(58) Field of Classification Search
USPC ..... 123/90.15–90.17, 90.27, 90.31, 90.6
See application file for complete search history.

(56) References Cited

U.S. PATENT DOCUMENTS

| | | | | |
|---|---|---|---|---|
| 5,235,939 | A | 8/1993 | Levin et al. | |
| 5,494,009 | A * | 2/1996 | Yamada et al. | 123/90.17 |
| 8,096,275 | B2 * | 1/2012 | Marriott et al. | 123/90.6 |
| 8,171,901 | B2 * | 5/2012 | Murata | 123/90.15 |

(Continued)

FOREIGN PATENT DOCUMENTS

| | | |
|---|---|---|
| CN | 103038458 A | 4/2013 |
| DE | 101 38 832 C1 | 1/2003 |

(Continued)

OTHER PUBLICATIONS

Japanese Office Action issued in Japaense Patent Application No. 2011-545192 on Apr. 26, 2012.

(Continued)

*Primary Examiner* — Thomas Denion
*Assistant Examiner* — Steven D Shipe
(74) *Attorney, Agent, or Firm* — Birch, Stewart, Kolasch & Birch, LLP

(57) ABSTRACT

In a variable valve actuation device for an internal combustion engine, a hollow boss (22*b*) is fitted around the outer periphery of an outer camshaft (15*a*) and protrudes from one side of a second cam (22*a*) located opposite a first cam (20) in the width direction of the second cam over a distance greater than the width of the second cam, in order to suppress misalignment of the boss.

11 Claims, 9 Drawing Sheets

(56) References Cited

U.S. PATENT DOCUMENTS

| | | | | |
|---|---|---|---|---|
| 8,453,615 | B2 * | 6/2013 | Lettmann et al. | 123/90.17 |
| 2005/0098128 | A1 | 5/2005 | Yokoyama et al. | |
| 2010/0000477 | A1 * | 1/2010 | Schneider | 123/90.6 |
| 2010/0282193 | A1 * | 11/2010 | Timothy et al. | 123/90.17 |
| 2011/0139103 | A1 * | 6/2011 | Davis | 123/90.17 |
| 2012/0067310 | A1 * | 3/2012 | Methley et al. | 123/90.15 |
| 2012/0145101 | A1 | 6/2012 | Yoshika et al. | |

FOREIGN PATENT DOCUMENTS

| | | | |
|---|---|---|---|
| DE | EP 2634385 | A1 * | 4/2013 |
| EP | 0 532 377 | A1 | 3/1993 |
| EP | 0532377 | A1 * | 3/1993 |
| EP | 2 505 795 | A1 | 10/2012 |
| GB | 2 456 792 | A | 7/2009 |
| JP | 9-170462 | A | 6/1997 |
| JP | 2000-213315 | A | 8/2000 |
| JP | 2009-144521 | A | 7/2009 |
| JP | 2009-144522 | A | 7/2009 |
| JP | 2009-293567 | A | 12/2009 |
| KP | 10-1994-0007340 | A | 4/1994 |
| KP | 10-2009-0103686 | A | 10/2009 |
| RU | 2 126 892 | C1 | 2/1999 |
| SU | 1195916 | A | 12/1980 |
| WO | WO 2008028902 | A1 * | 3/2008 |
| WO | WO 2009/005999 | A1 | 1/2009 |
| WO | WO 2009005999 | A1 * | 1/2009 |
| WO | WO 2014013409 | A3 * | 1/2014 |

OTHER PUBLICATIONS

Korean Office Action issued in Korean Patent Application No. 10-2012-7005388 on Dec. 3, 2012.

European Search Report issued in European Patent Application No. 10835897.9 on Mar. 7, 2013.

Russian Decision on Grant issued in Russian Patent Application No. 2012017557/06 on Jun. 4, 2013.

* cited by examiner

VARIABLE VALVE ACTUATION DEVICE FOR INTERNAL COMBUSTION ENGINE

BACKGROUND OF THE INVENTION

1. Field of the Invention

The present invention relates to a variable valve actuation device for an internal combustion engine, whereby the phase of one of a pair of cams for actuating a pair of intake or exhaust valves is varied relative to the other of the pair of cams by a cam phase change unit.

2. Description of the Related Art

In reciprocating engines (internal combustion engines) mounted on automobiles, a variable valve actuation device is often mounted to the cylinder head of the engine, with a view to improving exhaust gas emission characteristics or pumping loss of the engine.

Such variable valve actuation devices are constructed such that a phase difference between multiple valves (a pair of intake valves or exhaust valves) used in many engines is varied to change the period of time over which the multiple valves are opened. For example, out of a pair of cams for actuating a pair of intake or exhaust valves, respectively, the phase of one cam is varied relative to the other cam.

Many of variable valve actuation devices employ a configuration wherein a shaft member driven by crank output is fitted externally with a fixed first cam and a movable second cam rotatable about the axis of the shaft member such that the first and second cams correspond in position to a pair of intake or exhaust valves, and the phase of the movable second cam is varied relative to the fixed first cam as a reference cam by a cam phase change unit such as a movable vane mechanism, as disclosed in Patent Documents 1 and 2. That is, as the phase of the second cam is varied with reference to the first cam by the cam phase change unit, the period over which the pair of intake or exhaust valves are opened varies greatly. The support stability of the second cam fitted around the shaft member depends upon the width dimension of the second cam, and because of a small clearance provided between the second cam and the shaft member to allow the second cam to rotate relative to the shaft member, the second cam is liable to misalignment due to load applied thereto.

In order to maintain stability of the second cam, a component part having a hollow boss, for example, a cam lobe, is used as the second cam and is fitted at the boss around the shaft member so that the orientation of the second cam may be kept stable.

However, a space above a cylinder of the cylinder head where the first and second cams can be arranged is limited.

Accordingly, in the variable valve actuation devices for varying the phase of one cam relative to the other, the second cam has a one-sided structure such that the boss protrudes not on both sides of the second cam in the width direction of the second cam, but on only one side of the second cam close to the first cam, as disclosed in Patent Documents 1 and 2, in order to maintain stability of the second cam.

PRIOR ART LITERATURE

Patent Documents

Patent Document 1: Japanese Laid-open Patent Publication No. 2009-144521

Patent Document 2: Japanese Laid-open Patent Publication No. 2009-144522

SUMMARY OF THE INVENTION

Problems to be Solved by the Invention

However, even the boss configured in the aforementioned manner is liable to misalignment due to load applied thereto from one side thereof, and tilting of the second cam to one side in the width direction thereof is unavoidable. Such misalignment poses no particular problem if the amount of misalignment is within a predetermined allowable range.

Since the second cam having the boss is a component part separate from the shaft member, however, dimensional variation can arise because of tolerance of the second cam when the second cam is fitted around the shaft member. Thus, depending on the magnitude of the dimensional variation attributable to tolerance, a situation can possibly occur where the second cam is misaligned exceeding the allowable range. If such misalignment occurs, then local contact takes place. For example, the second cam locally contacts at its edge with the abutting surface of a follower member such as a tappet, or the supporting surface of the second cam or the boss locally contacts at its edge with the outer peripheral surface of the camshaft member. If this occurs, pressure acting upon the surfaces of the contacting component parts excessively increases, causing increased friction or local abrasion of the component parts. If friction increases or local abrasion of the component parts occurs, the variable valve actuation device fails to ensure predetermined engine performance. Also, excessively increased friction or excessive local abrasion may possibly lead to damage to the engine.

It is conceivable that the overall length of the boss is increased to reduce misalignment. However, since the first and second cams are arranged so as to correspond in position to the pair of intake or exhaust valves mounted on the head of the cylinder, dimensions available between the first and second cams are limited, making it difficult to lengthen the boss to such an extent that stability of the boss is ensured. In Patent Documents 1 and 2, therefore, the overall length of the boss is restricted to a length smaller than or equal to the width of the second cam, and it cannot be said that the stability of the boss is sufficiently high. If the overall length of the boss is increased in disregard of the dimensional restrictions, then the lengthened boss influences the first or second cam or with the intake valves (or exhaust valves).

Meanwhile, as the camshaft, a camshaft with an assembled structure, or what is called an assembled camshaft, is used which includes a shaft member having an inner camshaft rotatably fitted through an outer camshaft, which is a pipe member, as disclosed in Patent Documents 1 and 2, a fixed first cam formed on the outer periphery of the outer camshaft, a movable second cam arranged so as to be rotatable about the axis of the outer camshaft, and a connecting member configured to connect the second cam and the inner camshaft to each other while permitting relative displacement of the outer and inner camshafts. A cam phase change unit such as a rotary vane-type cam phase change unit is coupled to an end portion of the shaft member so that the phase of the second cam can be varied relative to the first cam, as a reference cam, in accordance with the relative displacement of the outer and inner camshafts.

In constructing this type of variable valve actuation device, the operation of coupling the cam phase change unit to the assembled camshaft should preferably be simplified and executed by means of as simple equipment as possible. To that end, the assembled camshaft needs to be held in an orientation when the cam phase change unit is coupled to the assembled camshaft.

It is an object of the present invention to provide a variable valve actuation device for an internal combustion engine in which misalignment of a second cam can be satisfactorily suppressed by a boss protruding sideways from the second cam, without influence with a first or second cam, and which can be easily assembled by a simple operation using simple equipment.

Means for Solving the Problems

To achieve the above object, there is provided in accordance with a first aspect of the invention, a variable valve actuation device for an internal combustion engine, for varying a phase difference between a pair of intake valves provided per cylinder of the engine or a phase difference between a pair of exhaust valves provided per cylinder of the engine. The variable valve actuation device comprises: an assembled camshaft including a shaft member which is driven by an output from a crankshaft of the engine and which has a first cam formed thereon for actuating one of the pair of intake or exhaust valves, and a cam lobe having a second cam for actuating the other of the pair of intake or exhaust valves and fitted around the shaft member so as to be displaceable relative to the shaft member in a circumferential direction of the shaft member; and a cam phase change unit configured to vary a phase of the second cam relative to that of the first cam, wherein the cam lobe has a hollow boss fitted around the shaft member, and the boss protrudes from one side of the second cam located opposite the first cam in a width direction of the second cam over a distance greater than the width of the second cam.

According to a second aspect of the invention, in the variable valve actuation device of the first aspect, the boss of the cam lobe has a connecting member connected to a control member for transmitting a variable cam phase, and the connecting member is arranged at an end portion of the boss remote from the second cam.

According to a third aspect of the invention, in the variable valve actuation device of the second aspect, the connecting member is arranged in a position spaced in an axial direction of the second cam from a member which is configured to actuate the corresponding valve while following movement of the second cam.

According to a fourth aspect of the invention, in the variable valve actuation device of the second or third aspect, the shaft member is constructed by rotatably fitting an inner camshaft as the control member through an outer camshaft, the assembled camshaft is configured such that the first cam is formed on an outer periphery of the outer camshaft, that the cam lobe having the second cam is rotatably fitted around the outer periphery of the outer camshaft, and that the connecting member connects the second cam and the inner camshaft to each other while allowing relative displacement of the outer and inner camshafts, the cam phase change unit is coupled to an end portion of the shaft member and causes the relative displacement of the outer and inner camshafts, the cam lobe is provided with a hold section permitting the assembled camshaft to be held in an orientation, and when the assembled camshaft is held in the orientation by using the hold section in order to couple the cam phase change unit to the end portion of the shaft member, the connecting member performs a function to prevent rotation of the inner camshaft.

According to a fifth aspect of the invention, in the variable valve actuation device of the fourth aspect, the hold section is provided on the boss.

According to a sixth aspect of the invention, in the variable valve actuation device of the fifth aspect, the hold section is constituted by at least one pair of flat surfaces formed on an outer periphery of the boss and permitting the boss to be clamped.

According to a seventh aspect of the invention, in the variable valve actuation device of the fifth aspect, the connecting member is a pin member inserted diametrically into the shaft member and penetrating through the boss and the outer and inner camshafts to connect the cam lobe and the inner camshaft to each other, diametrically opposite portions of the outer periphery of the boss where a through hole for the pin member opens have flat seating surfaces respectively surrounding open ends of the through hole through which the pin member is inserted, and the hold section is constituted by the seating surfaces of the boss.

According to an eighth aspect of the invention, in the variable valve actuation device of any one of the first to seventh aspects, the shaft member is rotatably arranged above the cylinder, the first and second cams are arranged adjacent to each other above the cylinder, and at least part of a shaft section located between the adjacent first and second cams is used as a journal rotatably supported above the cylinder.

Advantageous Effects of the Invention

According to the first aspect, the boss protrudes sideways from the second cam over a distance greater than the width of the second cam without influencing with the first or second cam, whereby misalignment of the boss is satisfactorily suppressed. Since misalignment of the second cam can be suppressed as a result, stability of the second cam fitted on the shaft member increases.

That is, excessive misalignment of the second cam can be suppressed just by means of the boss protruding sideways from the second cam, without affecting the layout of the first and second cams. Accordingly, misalignment of the second cam can be made to always fall within an allowable range, whereby increased friction or local abrasion of component parts in the variable valve actuation device is suppressed, making it possible to reduce variation in engine performance.

In the variable valve actuation device according to the second aspect, the control member for transmitting a variable cam phase and the boss of the cam lobe are connected to each other by the connecting member. Also in this case, misalignment of the second cam can be satisfactorily suppressed.

According to the third aspect, the connecting member is arranged outward of the member which actuates the corresponding valve while following the movement of the second cam. Thus, in the event that the connecting member projects to one side or drops off, for example, it is possible to avoid a situation where the connecting member engages with the valve actuation member, whereby serious damage to the engine can be prevented.

According to the fourth aspect, when the assembled camshaft is held in the orientation by using the hold section provided on the cam lobe with the second cam in order to couple the cam phase change unit to the assembled camshaft, movement of the connecting member is restricted because the connecting member is connected to the second cam, whereby rotation of the inner camshaft connected to the second cam is prevented.

Thus, the cam phase change unit and the inner camshaft can be coupled together by a simple operation using a simple rotation prevention structure for preventing rotation of the inner camshaft, which structure is constituted by the hold section also used for holding the assembled camshaft in the orientation. This coupling operation does not require the use of a special holding device, which can be burdensome, or the formation of a holding section on the inner camshaft, thus improving workability during the assembling of the camshaft as well as maintainability on the market. Further, the outer camshaft is applied with no external force during the coupling operation, so that deformation or warp of the outer camshaft does not occur.

According to the fifth aspect, the cam lobe having the second cam can be more easily provided with the hold section.

According to the sixth aspect, the assembled camshaft having the hold section with simpler construction can be held by general-purpose equipment.

According to the seventh aspect, the hold section is constituted by a pair of seating surfaces of the boss forming part of the structure for connecting the cam lobe and the inner camshaft to each other by the pin member. Thus, existing elements can be directly used as the hold section, making the hold section simpler in construction.

According to eighth aspect, the second cam is supported in its close vicinity by making use of the space between the first and second cams. It is therefore possible to suppress misalignment of the second cam attributable to warp of the shaft member, whereby sufficient stability of the second cam is secured by making full use of the limited space above the cylinder.

DETAILED DESCRIPTION OF THE INVENTION

One embodiment of the present invention will be hereinafter described with reference to FIGS. 1 through 9.

Figure 1:
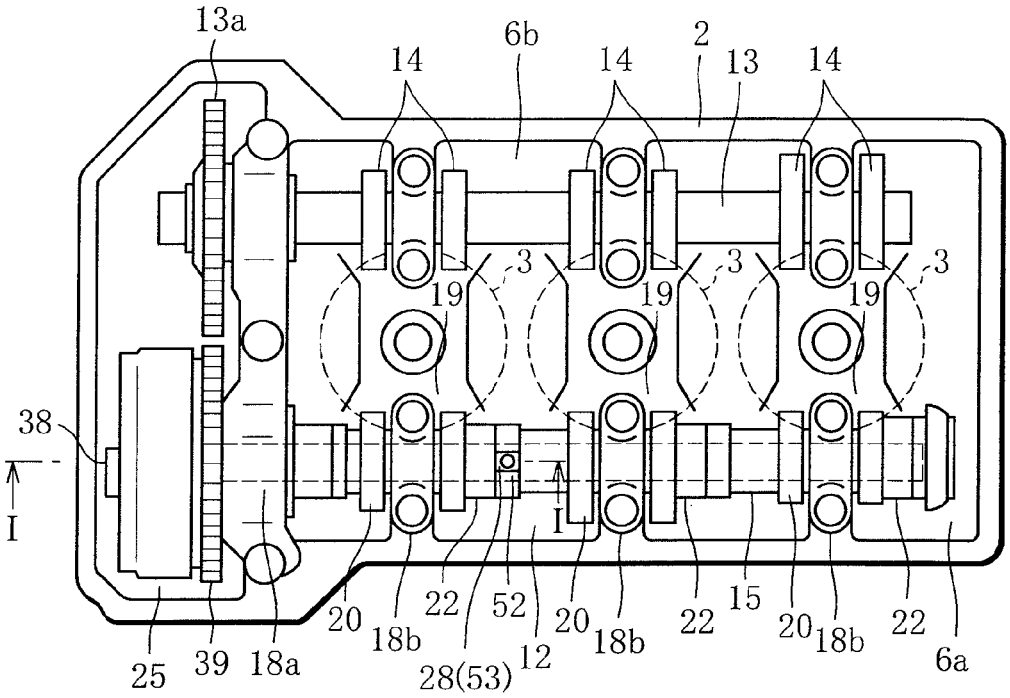
FIG. 1 is a plan view illustrating a variable valve actuation device according to the present invention, along with a cylinder head of an internal combustion engine to which the variable valve actuation device is mounted.
Figure 2:
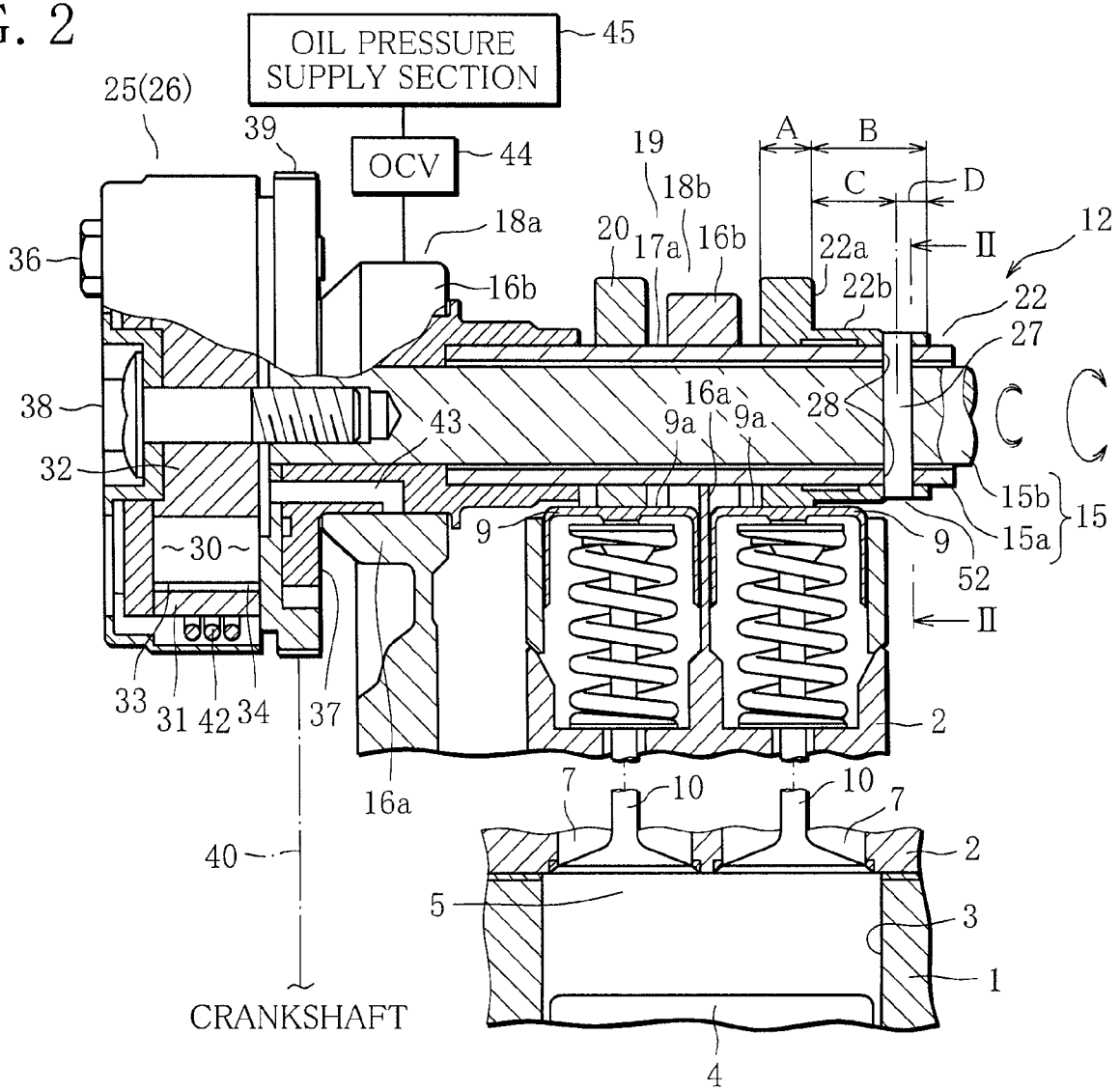
FIG. 2 is a sectional view of the variable valve actuation device, taken along line I-I in FIG. 1.

FIG. 1 is a plan view of an internal combustion engine, for example, a reciprocating engine (hereinafter merely referred to as engine) with three cylinders (multiple cylinders), and FIG. 2 is a sectional view taken along line I-I in FIG. 1. In the figures, reference numeral 1 denotes a cylinder block of the engine, and 2 denotes a cylinder head mounted to the head of the cylinder block 1.

As illustrated in FIGS. 1 and 2, three cylinders 3 (in the figures, only partly shown) are formed in the cylinder block 1 and arranged along the longitudinal direction of the engine. A piston 4 (illustrated in FIG. 2 only) connected to a crankshaft (not shown) by a connecting rod (not shown) is received in each cylinder 3 for reciprocating motion.

Combustion chambers 5 associated with the respective cylinders 3 are formed so as to face the lower surface of the cylinder head 2. A pair of intake ports 7 (two in number) for admitting air and a pair of exhaust ports (not shown) for discharging air open into each of the combustion chambers 5. The intake ports 7 are fitted with a pair of intake valves 10 (two in number but not limited to two), respectively, each having a tappet 9 (follower member) attached to an end of its stem. Each tappet 9 has a valve abutting surface 9*a* facing upward and located at the top of the cylinder head 2. The exhaust ports (not shown) are also fitted with a pair of exhaust valves (two in number but not limited to two, not shown), respectively, each having a tappet, like the intake valve. The intake ports 7 are opened and closed by the respective intake valves 10, and the exhaust ports (not shown) are opened and closed by the respective exhaust valves (not shown). Further, each combustion chamber 5 is provided with a spark plug, although not illustrated.

As illustrated in FIG. 1, an intake-side valve actuation device 6*a* and an exhaust-side valve actuation device 6*b*, each driven by the shaft output of the crankshaft, are arranged on the right and left sides of the upper part of the cylinder head 2 so that a predetermined combustion cycle (four-stroke cycle including an intake stroke, a compression stroke, an expansion stroke and an exhaust cycle) may repeatedly take place in each cylinder 3. Out of the valve actuation devices 6*a* and 6*b*, the exhaust-side valve actuation device 6*b* uses an ordinary camshaft 13 having pairs of exhaust cams 14 integrally formed thereon (e.g., by cutting). The camshaft 13 is rotatably mounted so as to extend in a direction in which the cylinders 3 are lined up, and the cam face of each exhaust cam 14 is disposed in contact with the proximal end of the corresponding exhaust valve (not shown). Consequently, the movement of each exhaust cam 14 is transmitted to the corresponding exhaust valve (not shown).

Figure 3:
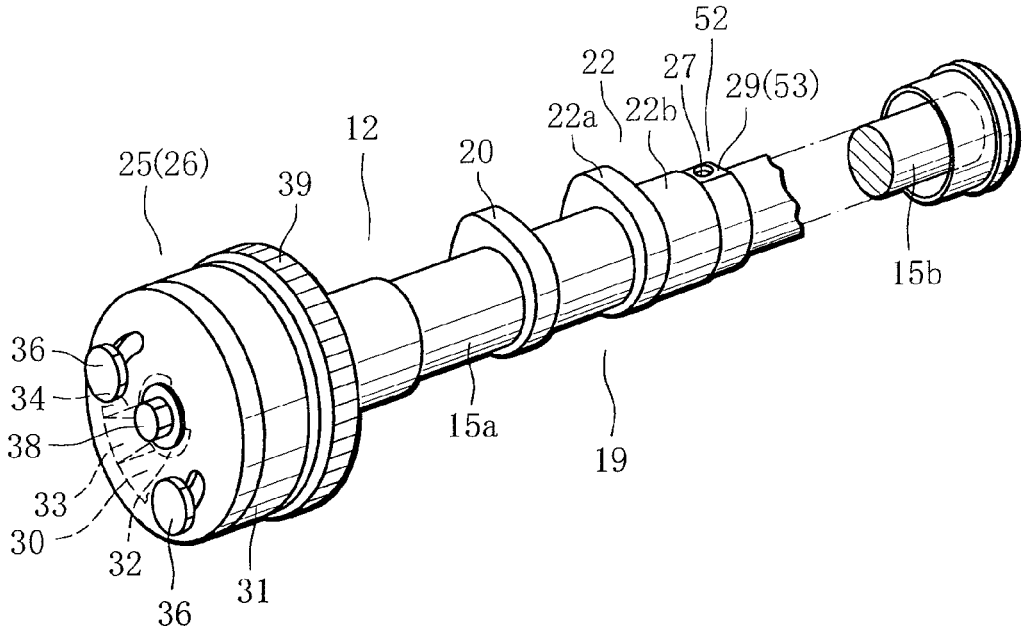
FIG. 3 is a perspective view illustrating a configuration of the variable valve actuation device.
Figure 4:
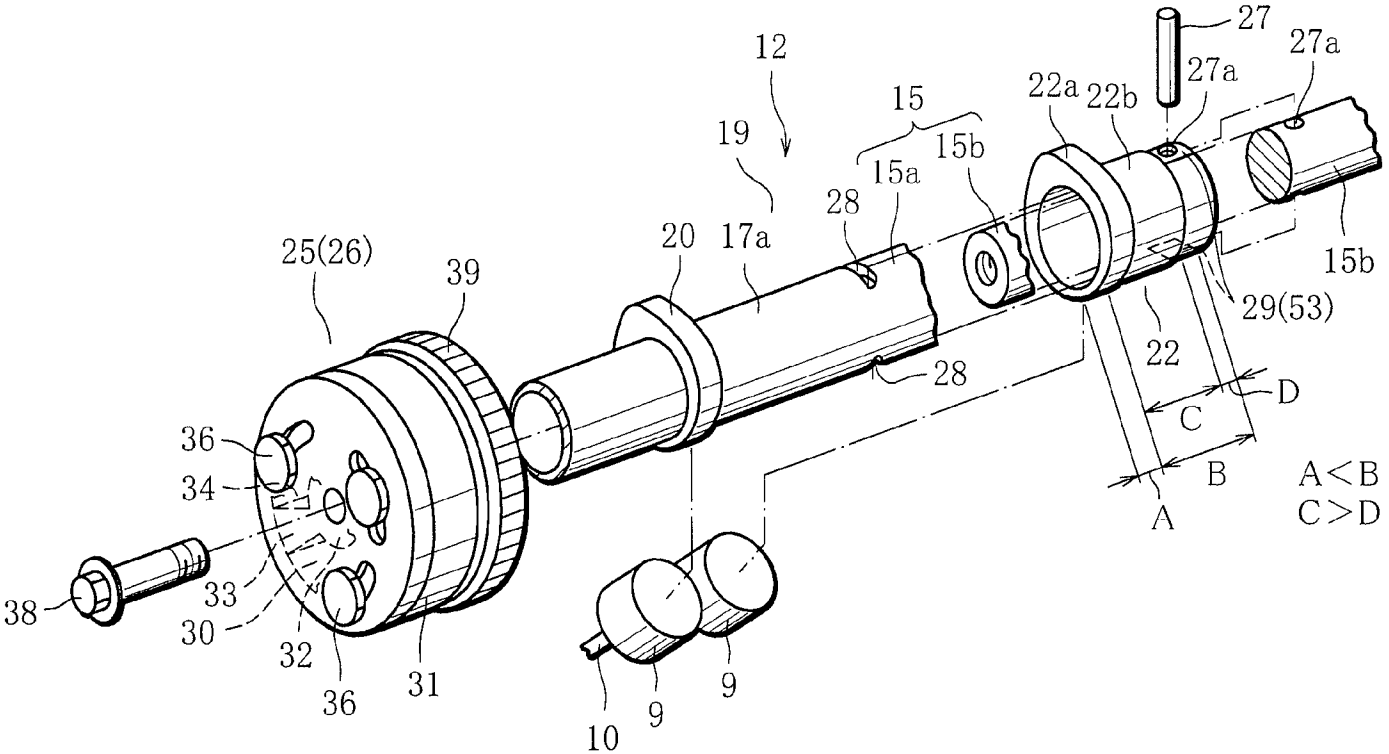
FIG. 4 is an exploded perspective view of the variable valve actuation device.

The intake-side valve actuation device 6*a*, on the other hand, uses a camshaft 15 (shaft member) constituted by separate members combined together as shown in FIGS. 2 to 4, unlike the exhaust-side camshaft 13. The camshaft 15 forms part of a split-type variable valve actuation device 12.

FIGS. 2 to 4 illustrate a variable structure of the variable valve actuation device 12 associated with one cylinder. Referring to the figures, the structure of the variable valve actuation device 12 will be explained. The camshaft 15 has one end portion rotatably supported by a bearing 18*a* arranged at a corresponding end portion of the cylinder head 2, and has an intermediate portion rotatably supported by bearings 18*b* arranged at respective appropriate portions of the cylinder head 2. The bearings 18*a* and 18*b* are each constituted by a bearing support 16*a* and a bearing cap 16*b* combined with the bearing support 16*a*, both provided at the cylinder head side. The camshaft 15 is provided with intake cams 19 such that each pair of intake cams 19 (two in number but not limited to two) is associated with a corresponding pair of intake valves 10 of one cylinder 3. Each pair of intake cams 19 comprises the combination of a fixed cam 20 (first cam) determining a reference phase and a cam lobe 22 serving as a movable cam.

A double shaft is used for the camshaft 15. A cam phase change unit 25 is attached to one end of the double shaft. Inner and outer shafts of the double shaft are rotationally displaced relative to each other by the cam phase change unit 25, in order to vary the phase of the cam lobe 22 relative to that of the fixed cam 20 (assembled camshaft).

Specifically, the camshaft 15 is constituted, for example, by an outer camshaft 15*a*, which is a hollow pipe member, and an inner camshaft 15*b* (control member), which is a solid shaft member rotatably fitted through the outer camshaft 15*a* and serves as a control member, as illustrated in FIGS. 2 to 4. A clearance is provided between the outer and inner camshafts 15*a* and 15*b* to permit relative displacement of the camshafts 15*a* and 15*b*. End portions of the outer and inner camshafts 15*a* and 15*b*, in this embodiment, one end portion of the outer camshaft 15*a* is rotatably supported by the bearing 18*a* at the one end of the cylinder head 2 through the agency of a bracket 37 attached to the corresponding end of the outer camshaft 15*a*. The outer camshaft 15*a* is rotatably supported at its intermediate portion by the bearings 18*b* each situated between the corresponding pair of tappets 9, 9. Thus, the camshafts 15*a* and 15*b* can both be rotated about the same axis. The paired intake cams 19 are provided on the outer camshaft 15*a* such that each pair (two in number) is associated with the corresponding cylinder.

The fixed cam 20 associated with each of the cylinders 3 is constituted by a plate cam, as illustrated in FIGS. 2 to 4. The plate cam is attached, for example, fixed by press fitting, to the outer periphery of the outer camshaft 15*a*. The fixed cam 20 is located immediately above the corresponding left-hand tappet 9. A cam nose formed on the outer periphery of the fixed cam 20 is disposed in contact with the valve abutting surface 9*a* of the left-hand tappet 9, so that radial cam displacement of the cam nose is transmitted to the left-hand intake valve 10 to actuate same.

Figure 5:
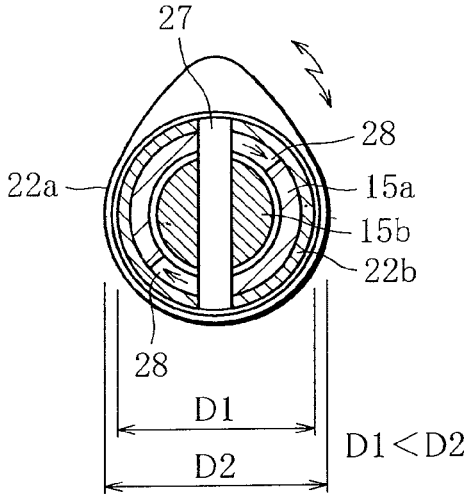
FIG. 5 is a sectional view taken along line II-II in FIG. 2.

The cam lobe 22 associated with each of the cylinders 3 has a cam nose 22*a* (second cam) constituted by a plate cam. In order to ensure stability of the cam nose 22*a*, the cam nose 22*a* has a hollow boss, for example, a cylindrical boss 22*b* combined therewith, and the cam nose 22*a* and the boss 22*b* constitute the whole cam lobe 22. The cam nose 22*a* is fitted, together with the boss 22*b*, around the outer camshaft 15*a* so as to be displaceable in the circumferential direction, and is arranged in a position adjacent to the fixed cam 20 associated therewith, that is, immediately above the right-hand tappet 9. The cam nose 22*a* is disposed in contact with the valve abutting surface 9*a* of the right-hand tappet 9, and thus radial cam displacement of the cam nose 22*a* is transmitted to the right-hand intake valve 10, so that the intake valve 10 is actuated. FIG. 5 is a sectional view taken along line II-II in FIG. 2. As illustrated in the figure, the boss 22*b* has an outer diameter D1 smaller than a base circle D2 of the cam nose 22*a* (D1<D2) so that the boss 22*b* may not come into contact with the tappet 9. The boss 22*b* will be described in detail later.

Also, as shown in FIG. 5, each boss 22*b* and that portion of the inner camshaft 15*b* which is located radially inward of the boss 22*b* are coupled together by a pin member penetrating through the boss 22*b* and the inner camshaft 15*b*, for example, by a press fitting pin 27 (connecting member). Further, an elongate hole permitting movement of the press fitting pin 27, for example, an elongate hole 28 extending in a retarding direction, is formed in a portion of the peripheral wall of the outer camshaft 15*a* where the press fitting pin 27 passes, so that as the inner camshaft 15*b* is rotationally displaced relative to the outer camshaft 15*a*, the phase of each cam nose 22*a* can be significantly retarded with respect to the phase of the corresponding fixed cam 20 as a reference cam. Reference sign 27*a* (FIG. 4) denotes a press fitting hole formed through the inner camshaft 15*b* and the peripheral wall of the boss 22*b* to allow the press fitting pin 27 to be press-fitted.

In order that the press fitting pin 27 may be press-fitted without entailing deformation of components parts, each boss 22*b* has flat seats formed on portions (diametrically opposite portions) of the outer peripheral surface thereof where the through hole 27*a* for the press fitting pin 27 opens, that is, a pair of flat seating surfaces 29 surrounding the respective opposite open ends of the press fitting hole 27*a*, as illustrated in FIGS. 3 and 4.

For the cam phase change unit 25, a hydraulic rotary vane mechanism 26 is used, for example, which is attached to one end of the camshaft 15, as shown in FIGS. 2 to 4, to drive the outer and inner camshafts 15*a* and 15*b* relative to each other. The rotary vane mechanism 26 includes, for example, a cylindrical housing 31 having a plurality of retardation chambers 30 formed therein and arranged in a circumferential direction thereof, and a vane section 34 rotatably received in the housing 31 and having a plurality of vanes 33 radially protruding from the outer periphery of a shaft portion 32, each retardation chamber 30 being partitioned by the corresponding vanes 33. A timing sprocket 39 is formed on the outer periphery of the housing 31. The sprocket 39 is connected to the crankshaft (not shown) by a timing chain 40.

The housing 31 is coupled by means of fixing bolts 36 to the bracket 37 attached to the one end of the outer camshaft 15*a*, and the shaft portion 32 of the vane section 34 is coupled by means of a fixing bolt 38 to the one end of the inner camshaft 15*b*. Thus, as the vanes 33 revolve within the retardation chambers 30, the inner camshaft 15*b* rotates relative to the outer camshaft 15*a*.

Specifically, the cam phase of the cam nose 22*a* is made to coincide with that of the fixed cam 20 as the reference cam by the urging force of a return spring member 42 (shown in FIG. 2 only) connecting the housing 31 and the vane section 34 to each other. On the other hand, the retardation chambers 30 are individually connected to an oil control valve 44 (hereinafter referred to as OCV 44) and an oil pressure supply section 44 (constituted, e.g., by an oil pump for supplying oil) via an oil passage 43 (only partly shown in FIG. 2) formed in various component parts such as the housing 31, the bracket 37, and the bearing 18*a*. When the oil is supplied to the interior of the individual retardation chambers 30, the inner camshaft 15*b* is driven, with the result that the cam lobe 22 is displaced in the retarding direction from the fixed cam 20.

Figure 6:
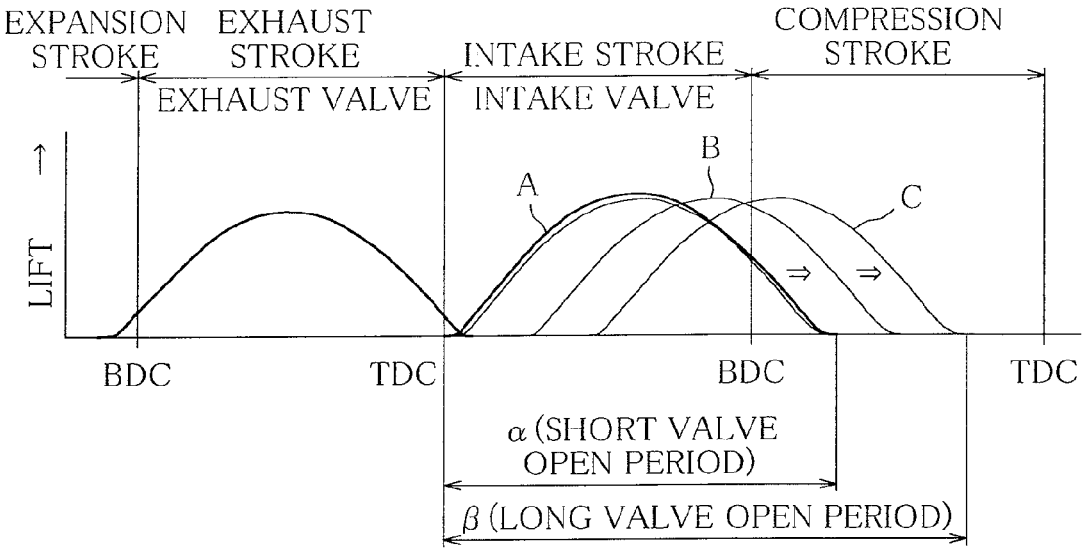
FIG. 6 is a diagram illustrating variable characteristics of the variable valve actuation device.

Because of the aforementioned configuration, split variable control can be performed by using the cam nose 22*a*, as illustrated in FIG. 6. Specifically, the shaft output of the crankshaft is transmitted to the outer camshaft 15*a* through the timing chain 40, the timing sprocket 39, the housing 31 and the bracket 37 to rotate the fixed cam 20, so that the left-hand intake valve 10*a* is opened and closed by means of the tappet 9. If, at this time, no oil pressure is output from the OCV 44, the cam phase of the cam nose 22*a* is caused to coincide with that of the fixed cam 20 by the urging force of the return spring member 42, as indicated by state A in FIG. 6. Accordingly, the right-hand intake valve 10*b* is opened and closed in phase with the fixed cam 20.

On the other hand, when the oil pressure is supplied from the oil pressure supply section 45 to the interior of the individual retardation chambers 30 through the OCV 44, the vanes 33 are displaced within the retardation chambers 30 in the retarding direction from their initial position in accordance with the oil pressure applied thereto. When the vanes 33 are moved to an intermediate position within the retardation chambers 30, for example, by oil pressure output control, the inner camshaft 15*b* is displaced in the retarding direction up to an intermediate position. This displacement is transmitted to the cam lobe 22 through the press fitting pin 27, displacing the cam lobe 22 in the retarding direction. Consequently, the open/close timing of the right-hand intake valve 10*b* alone varies while the reference open/close timing of the left-hand intake valve 10*a* remains unchanged, as indicated by state B in FIG. 6.

When the vanes 33 are moved to the most retarded position by the oil pressure output control, the reference open/close timing of the left-hand intake valve 10*a* remains unchanged, but the right-hand intake valve 10*b* is opened and closed at the times most retarded from the opening and closing times of the left-hand intake valve 10*a* with the open/close timing thereof shifted from that of the left-hand intake valve 10*a*, as indicated by state C in FIG. 6. Namely, depending on the phase of the cam nose 22*a* with respect to that of the fixed cam 20 as the reference cam, the overall valve open period of the left- and right-hand intake valves 10*a* and 10*b* varies within a range from the shortest valve open period a to the longest valve open period β, as shown in FIG. 6.

In order to ensure stability of the cam nose 22*a* of the variable valve actuation device 12, the means explained below are adopted in conjunction with the formation of the boss 22*b*.

- Configuration is employed wherein at least part of the camshaft section located between the fixed cam 20 and the cam nose 22*a* is used as a cam journal 17*a* (journal). That is, the space above the cylinder is utilized to support the outer camshaft 15*a* such that the intermediate portion of the outer camshaft 15*a* is rotatably supported by the bearings 18*b* each arranged between the corresponding pair of tappets 9, whereby space can be secured on one side of the cylinder while at the same time warp of the outer camshaft 15*a* above the cylinder can be suppressed.
- Configuration is employed wherein the boss 22*b* protrudes on the side opposite the fixed cam 20. That is, the boss 22*b* is configured to protrude from the side of the cam nose 22*a* located opposite the fixed cam 20, so that the boss 22*b* may protrude into the space secured on the side of the cylinder thanks to the above structural feature.
- Configuration is employed wherein, as illustrated in FIGS. 2 and 4, the overall length B of the boss 22*b* is extended to an extent such that stability is secured. Specifically, the boss 22*b* is configured to protrude on the side opposite the fixed cam 20 over a distance longer than the cam width A of the cam nose 22*a*.
- Configuration is employed wherein the press fitting pin 27 is arranged at the end portion of the boss 22*b* remote from the cam nose 22*a*.
- Configuration is employed wherein the press fitting pin 27 is located outward of the tappet 9 (driven member) for actuating the valve (i.e., located in a position spaced from the tappet 9 in the axial direction of the cam).

Figure 7:
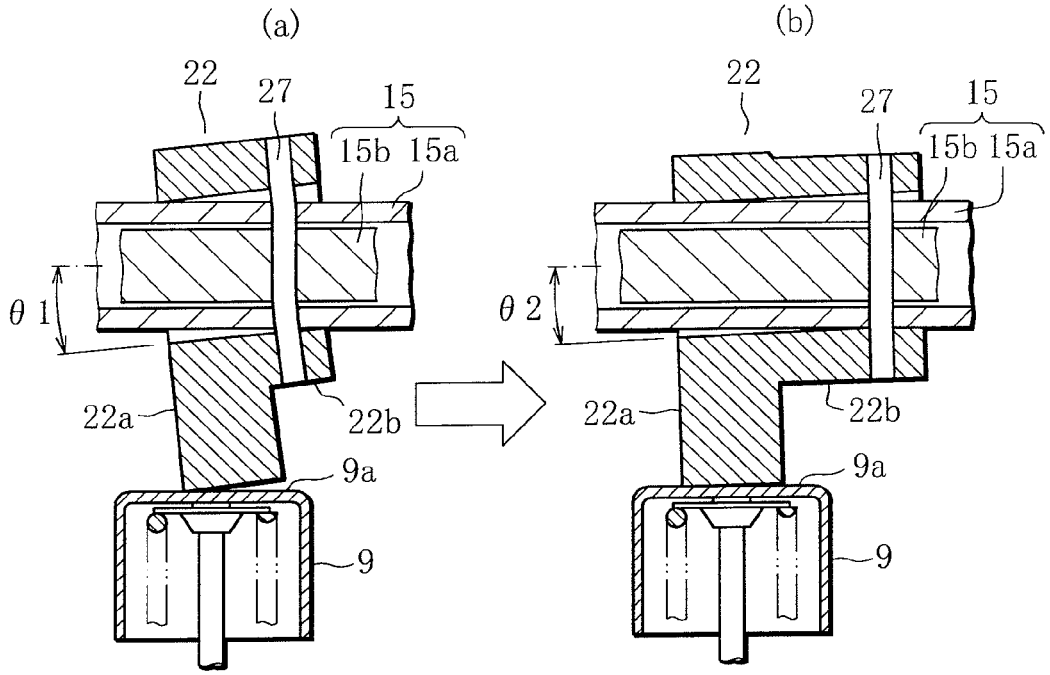
FIG. 7 is a sectional view illustrating misalignment of the variable valve actuation device, in comparison with misalignment of a conventional device.

Because of the structural features stated above, the boss 22*b* can be configured to protrude from the cam nose 22*a* not toward the fixed cam 20, but to the side opposite the fixed cam 20, and thus can be lengthened (extended) without influencing with the fixed cam 20 and the cam nose 22*a* laid out in a predetermined manner. Especially, the overall length B of the boss 22*b* is set to such a dimension that the boss 22*b* protrudes over a distance longer than the cam width A of the cam nose 22*a* that receives load, whereby misalignment (tilting) of the boss 22*b* is suppressed, enhancing the stability of the cam lobe 22 fitted on the outer camshaft 15*a*. Specifically, if the cam lobe 22 is configured such that the length of the boss 22*b* is shorter than (or equal to) the cam width of the cam nose 22*a* as illustrated in FIG. 7(*a*), the boss 22*b* is unstable and may possibly be tilted beyond an allowable range (θ1 in FIG. 7) due to tolerances such as component tolerance and assembling tolerance, with the result that the cam nose 22*a* locally contacts at its edge with the abutting surface 9*a* of the tappet 9 due to misalignment attributable to the tilting of the cam lobe 22. On the other hand, where the overall length B of the boss 22*b* is longer than the cam width A of the cam nose 22*a* (A<B), the misalignment is suppressed and the stability of the boss 22*b* is greatly enhanced. Even under the influence of similar tolerances, the misalignment (tilting) of the cam nose 22*a* can be satisfactorily suppressed as illustrated in FIG. 7(*b*) (in FIG. 7, θ2<θ1).

Thus, excessive misalignment (tilting) of the cam nose 22*a* can be suppressed by merely causing the boss 22*b* to protrude from one side of the cam nose 22*a*, without affecting the layout of the fixed cam 20 and the cam nose 22*a*. Misalignment of the cam nose 22 can therefore be made to always fall within the allowable range, thereby preventing increased friction or local abrasion attributable to the misalignment of the cam nose 22*a* and suppressing variation in the variable control performance.

Also, in the case of the configuration wherein the boss 22*b* and the inner camshaft 15*b* (control member) are connected to each other by the press fitting pin 27 (connecting member) in order to transmit the variable cam phase to the cam lobe 22, the misalignment of the cam nose 22*a* can be satisfactorily suppressed by merely arranging the press fitting pin 27 in such a manner that the press fitting pin 27 is located at the end portion of the boss 22*b* remote from the cam nose 22*a*, more specifically, in a position close to the end portion of the boss 22*b* opposite the cam nose 22*a* as indicated by C>D in FIGS. 2 to 4, and also that the press fitting pin 27 is located outward of the tappet 9 (driven member), which actuates the valve.

Especially, if the press fitting pin 27 is located just above the tappet 9 and comes out of the insertion hole for some reason or other, the press fitting pin 27 itself may actuate the tappet 9 with timing different from that determined by the cam nose 22*a* or may drop off into the space between the tappet 9 and the outer camshaft, possibly leading to serious failure such as interference between the valve and the piston. By arranging the press fitting pin 27 so as to be located outward of the tappet 9 (driven member) for actuating the valve, it is possible to significantly reduce the possibility of the press fitting pin 27 causing serious failure. The same effect can be achieved also in the case where the valve actuating member is constituted by a rocker arm having a roller incorporated therein, instead of the tappet 9.

Also, especially in the case of the configuration wherein the portion of the outer camshaft 15*a* between the fixed cam 20 and the cam nose 22*a* adjacent to each other is used as the cam journal 17*a* and the cam journal 17*a* is rotatably supported by the bearing 18*b* located above the cylinder 3, the cam nose 22*a* is supported by the bearing 18*b* located in its close vicinity. Accordingly, misalignment of the cam nose 22*a* attributable to warp of the outer camshaft 15*a* can also be suppressed. Moreover, since the outer camshaft 15*a* is supported by making use of the space above the cylinder 3, a space can be secured on one side of the cam lobe 22, allowing the boss 22*b* to protrude into that space. It is therefore possible to ensure sufficient stability of the cam nose 22*a* while making efficient use of the limited space above the cylinder 3.

The camshaft 15 of the variable valve actuation device 12 is configured such that the inner camshaft 15*b* is rotatably fitted through the outer camshaft 15*a*. Because of this specific configuration, the inner camshaft 15*b* is subject to rotational displacement. With the camshaft 15, therefore, difficulty arises in the operation of coupling the cam phase change unit 25 to the end of the inner camshaft 15*b*.

Thus, the camshaft 15 is provided with a means for preventing rotation of the inner camshaft 15*b* to facilitate the coupling operation. Specifically, as illustrated in FIGS. 3 and 4, each cam lobe 22 is provided with a hold section 52 which can be held by general-purpose equipment to keep the whole camshaft 15 in an orientation when the cam phase change unit 25 is coupled to the end of the camshaft 15, which is a double shaft. When the camshaft 15 is held at the hold section 52, the hold section 52 per se serves to prevent rotation of the inner camshaft 15*b*.

Specifically, the hold section 52 is provided on the boss 22*b* that is formed to suppress misalignment of the cam nose 22*a*. The hold section 52 is constituted by a pair of parallel flat surfaces 53 (two parallel flats) formed on diametrically opposite portions of the outer periphery of the boss 22*b*. Thus, the boss 22*b* with the pair of flat surfaces 53 can be clamped by a clamping device, which is general-purpose equipment. As the boss 22*b* is clamped, the camshaft 15 as a whole can be held in an orientation. It is therefore possible to improve workability at the time of assembling as well as maintainability on the market. Also, since the hold section 52 is formed at a distance from the cam nose 22*a*, it is also possible to significantly reduce the possibility of the cam nose or tappets being accidentally damaged during the maintenance on the market.

In the case of the configuration wherein the boss 22*b* and the inner camshaft 15*b* are coupled together by press-fitting or inserting the press fitting pin 27 as illustrated in FIG. 2, the press fitting pin 27 is inserted up to a predetermined position by using general-purpose equipment. Usually, therefore, a pair of seating surfaces 29 surrounding the open ends (in communication with the press fitting hole 27*a*) through which the press fitting pin 27 is inserted are formed on diametrically opposite portions of the outer periphery of the boss 22*b* where the press fitting hole 27*a* for the press fitting pin 27 opens. In such cases, the flat surfaces 53 need not be separately formed and the seating surfaces 29 may be directly used as the flat surfaces 53 (hold section 52). This eliminates the need to separately form the paired flat surfaces 53, and also since the length of the boss 22*b* can be set to a smaller length, weight and space can advantageously be saved. Further, the press fitting pin 27 serves to prevent deformation of the clamped boss 22*b*. This embodiment exemplifies the case where the flat surfaces 53 are constituted by a pair of seating surfaces 29.

Figure 8:
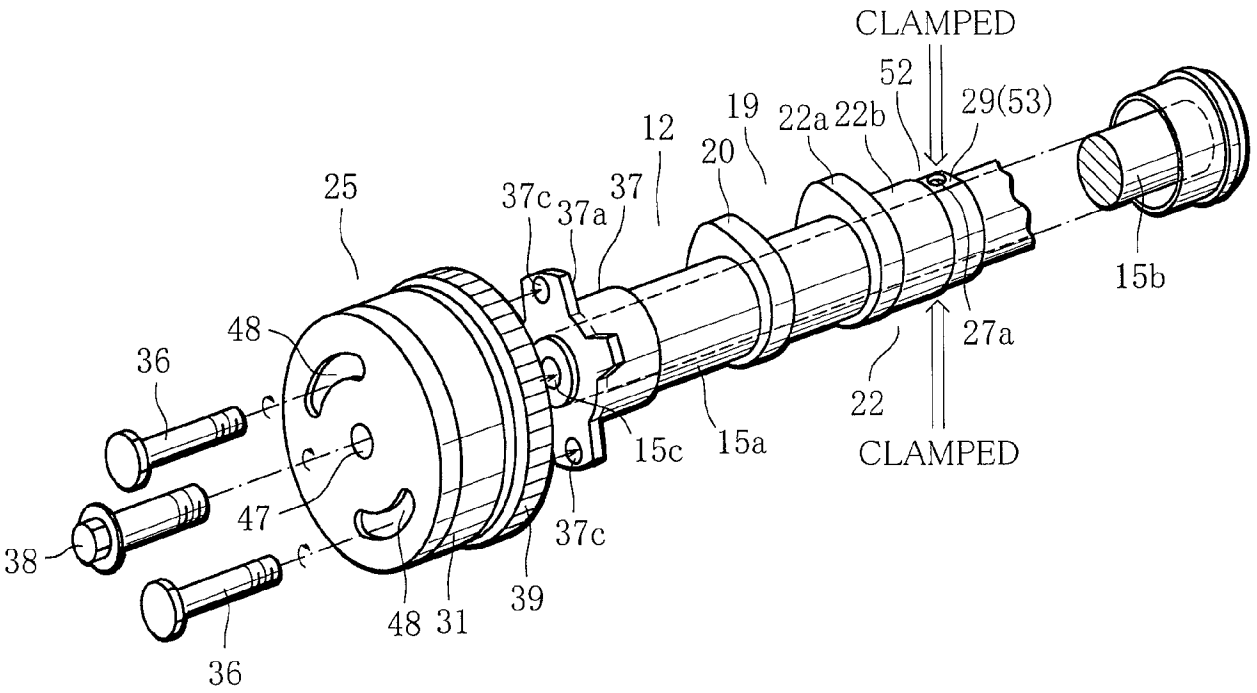
FIG. 8 is a perspective view illustrating the manner of how a camshaft and a cam phase change unit are coupled together.
Figure 9:
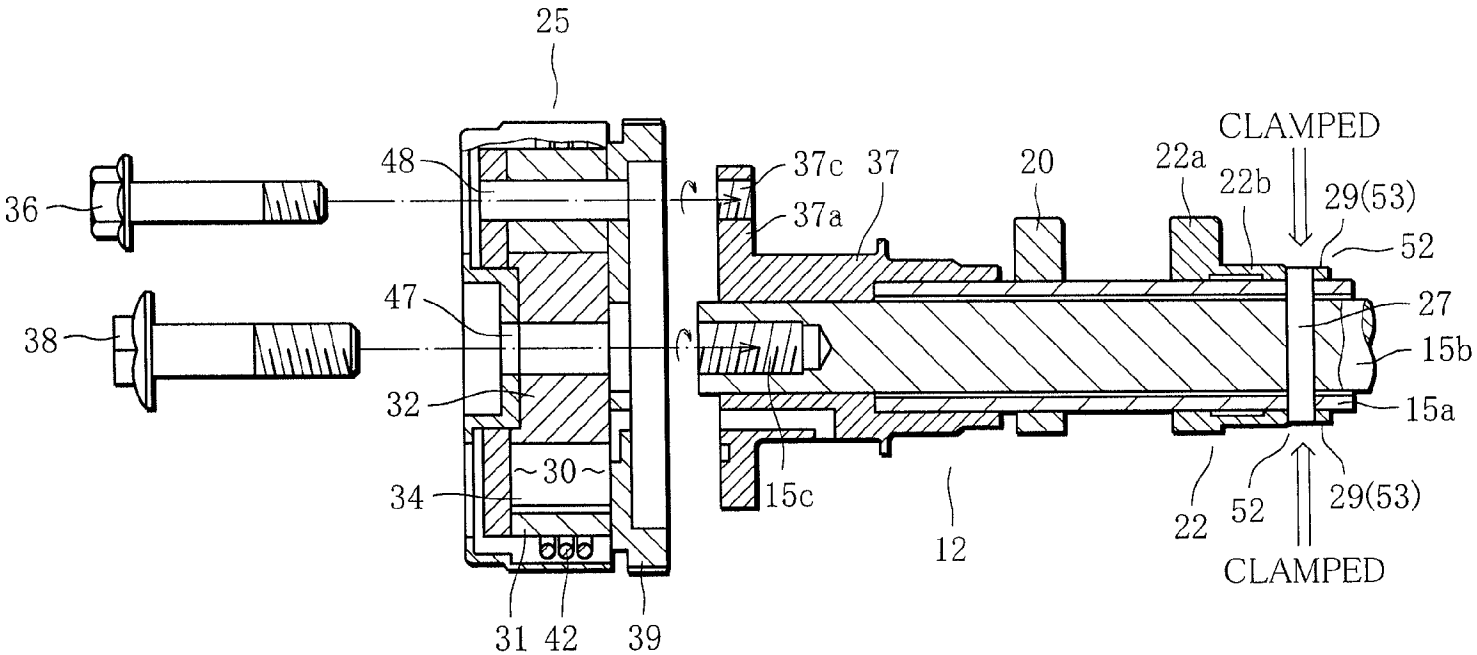
FIG. 9 is a sectional view illustrating the manner of how the camshaft and the cam phase change unit are coupled together.

The use of the hold section 52 makes it easy to couple the end portion of the camshaft 15 and the output section of the cam phase change unit 25 to each other, as shown in FIGS. 8 and 9.

Specifically, when the end portion of the camshaft 15 and the output section of the cam phase change unit 25 are to be coupled together to construct the variable valve actuation assembly illustrated in FIG. 3, each cam lobe 22 fitted around the outer periphery of the outer camshaft 15*a* is clamped at its paired flat surfaces 53, as illustrated in FIGS. 8 and 9, by general-purpose equipment, not shown, and the camshaft 15 as a whole is held in an orientation suited for the coupling operation. The cam phase change unit 25 is positioned close to that end portion of the camshaft 15 which is provided with a cam piece 37, and the bolt hole 47 formed axially through the housing 31 of the cam phase change unit 25 is aligned with a threaded hole 15*c* formed axially in the end portion of the inner camshaft 15*b*. Then, the multiple bolt holes 48 formed through the outer peripheral portion of the housing 31 are aligned with respective threaded holes 37*c* formed through arms 37*a* protruding radially outward from the cam piece 37. Subsequently, the fixing bolts 36 are screwed into the respective bolt holes 48, whereupon the cam phase change unit 25 is coupled to the end of the outer camshaft 15*a*. Further, the fixing bolt 38 is inserted through the bolt hole 47 in the center of the housing 31 and screwed into the threaded hole 15*c* of the inner camshaft 15*b*.

Since, at this time, the press fitting pin 27 is connected to the boss 22*b* and also the cam lobe 22 is held at the flat surfaces 53, movement of the press fitting pin 27 is restricted. Also, the press fitting pin 27 is connected to the inner camshaft 15*b* rotatably fitted through the outer camshaft 15*a*, and therefore, rotation of the inner camshaft 15*b* is prevented by the press fitting pin 27. Since rotation of the inner camshaft 15*b* is prevented, the fixing bolt 38 can be screwed into the threaded hole 15*c* of the inner camshaft 15*b*, as illustrated in FIG. 3, whereby the vane section 34 of the cam phase change unit 25 is coupled to the end portion of the inner camshaft 15*b*.

In this manner, the hold section 52 is used not only to hold the camshaft 15 in the orientation but to prevent rotation of the inner camshaft 15*b*, and therefore, the inner camshaft 15*b* and the cam phase change unit 25 can be coupled together without the need to use a special holding device. Since no separate operation is required to prevent rotation of the inner camshaft 15*b*, the coupling operation can be performed with ease. During the coupling operation, moreover, the outer camshaft 15*a* is applied with no external force. Accordingly, deformation or warp of the outer camshaft 15*a* does not occur, making it possible to suppress increased friction between the outer camshaft 15*a* and the journal bearing 18*b* of the cylinder head 2 and between the cam (cam nose 22*a*) and the tappet. As a result, abnormal abrasion of the individual component parts due to increased friction, damage to the component parts attributable to abnormal abrasion and thus damage to the engine can be prevented.

The hold section 52 has a simple construction because, in the case of the cam lobe 22 provided with the boss 22*b*, the hold section 52 can be formed on the boss 22*b*. Further, where the hold section 52 is constituted by a pair of flat surfaces 53 formed on the outer periphery of the boss 22*b*, the camshaft can be easily held by general-purpose equipment. Each of the multiple cam lobes 22 of the multi-cylinder engine may be provided with the hold section 52. In this case, the hold section 52 corresponding to any one of the cylinders may be held by general-purpose equipment in order to prevent rotation of the inner camshaft, whereby maintenance and assembling are facilitated.

Especially in the case where a pair of seating surfaces 29 are already formed on the outer periphery of the boss 22*b*, the seating surfaces 29 per se can be used as the flat surfaces 53, providing the advantage that the hold section 52 can be constituted by using existing elements without the need for any additional machining or the like.

Further, the cam nose 22*a* may be formed by using, as a reference position, the pair of flat surfaces 53 formed on the outer periphery of the boss 22*b* of the cam lobe 22 or the press fitting hole 27*a* for the press fitting pin 27. In this case, the positional accuracy of the cam nose 22*a* in the direction of assembling can be checked and confirmed by means of the flat surfaces 53 or the press fitting hole 27*a* when the cams are assembled, enhancing the productivity of the camshaft 15.

While the variable valve actuation device for an internal combustion engine according to the present invention has been described above, it is to be noted that the present invention is not limited to the foregoing embodiment.

For example, in the above embodiment, the present invention is applied to the variable valve actuation device configured to vary the phases of a pair of intake cams for actuating a pair of intake valves, respectively. The device to which the present invention is applicable is not limited to such a variable valve actuation device, and the present invention may be applied to a variable valve actuation device which is configured to vary the phases of a pair of exhaust cams for actuating a pair of exhaust valves, respectively. In this case, the intake valves are replaced by the exhaust valves, and the intake cams by the exhaust cams. Also, the variable valve actuation device may be configured such that the variable phase change mechanism is used in combination with a conventional variable phase change mechanism (mechanism capable of varying the phases of both valves at the same time). In this case, the timing sprocket may be attached to either of the two variable phase change mechanisms.

Further, in the foregoing embodiment, a pair of flat surfaces is exemplified as the hold section. The hold section to be used is, however, not limited to the one explained with reference to the embodiment and may be constituted by two or three pairs of flat surfaces or some other suitable structural means insofar as the hold section permits the cam lobe to be held in position and can prevent rotation of the inner camshaft.

EXPLANATION OF REFERENCE SIGNS

3: cylinder
12: variable valve actuation device
15: camshaft (shaft member)
15*a*: outer camshaft
15*b*: inner camshaft (control member)
17*a*: cam journal (journal)
19: pair of intake cams
20: fixed cam (first cam)
22: cam lobe
22*a*: cam nose (second cam)
22*b*: boss
25: cam phase change unit
27: press fitting pin (connecting member)
29: seating surface
52: hold section
53: flat surface

The invention claimed is:

1. A variable valve actuation device far an internal combustion engine, far varying a phase difference between is pair of intake valves provided per cylinder of the engine or a phase difference between a pair of exhaust valves provided per cylinder of the engine, comprising:

an assembled camshaft including a shaft member which is driven by an output from a crankshaft of the engine and which has a first cam formed thereon for actuating one of the pair of intake or exhaust valves, and a cam lobe having a second cam far actuating the other of the pair of intake or exhaust valves and fitted around the shaft member so as to be displaceable relative to the shaft member in a circumferential direction of the shaft member; and a cam phase change unit configured to vary a phase of the second cam relative to that of the first cam, wherein the cam lobe has a hollow boss fitted around the shaft member, the boss protrudes from one side of the second cam located opposite the first cam in a width direction of the second cam over a distance greater than the width of the second cam, and has a connecting member connected to a control member for transmitting a variable cam phase, and the connecting member is arranged in a position closer to an end portion of the boss opposite the second cam than to the second cam.

2. The variable valve actuation device according to claim 1, wherein one of the pair of intake valves or one of the pair of exhaust valves has, at an upper end thereof, a follower member that makes contact with the second cam, a width of the follower member in the axial direction of the second cam is larger than a width of the second cam, and wherein the connecting member is arranged in a position offset in the axial direction from the follower member.

3. The variable valve actuation device according to claim 2, wherein:

the shaft member is constructed by rotatably fitting an inner camshaft as the control member through an outer camshaft, the assembled camshaft is configured such that the first cam is formed on an outer periphery of the outer camshaft, that the cam lobe having the second cam is rotatably fitted around the outer periphery of the outer camshaft, and that the connecting member connects the second cam and the inner camshaft to each other while allowing relative displacement of the outer and inner camshafts, the cam phase change unit is coupled to an end portion of the shaft member and causes the relative displacement of the outer and inner camshafts, the cam lobe has a hold section that permits the assembled camshaft to be held in an orientation and when the assembled camshaft is held in the orientation by using the hold section in order to couple the cam phase change unit to the end portion of the shaft member, the connecting member performs a function to prevent rotation of the inner camshaft.

4. The variable valve, actuation device according to claim 3, wherein the hold section is provided on the boss.

5. The variable valve actuation device according to claim 4, wherein the hold section is constituted by at least one pair of flat surfaces formed on an outer periphery of the boss and permitting the boss to be clamped.

6. The variable valve actuation device according to claim 4, wherein:

the connecting member is a pin member inserted diametrically into the shaft member and penetrating through the boss and the outer and inner camshafts to connect the cam lobe and the inner camshaft to each other, diametrically opposite portions of the outer periphery of the boss where a through hole for the pin member opens have flat seating surfaces respective surrounding open ends of the through hole through which the pin member is inserted, and the hold section is constituted by the seating surfaces of the boss.

7. The variable valve actuation device according to claim 1, wherein:

the shaft member is constructed by rotatably fitting an inner camshaft as the control member through an outer camshaft, the assembled camshaft is configured such that the first cam is formed on an outer periphery of the outer camshaft, that the cam lobe having the second cam is rotatably fitted around the outer periphery of the outer camshaft, and that the connecting member connects the second cam and the inner camshaft to each other while allowing relative displacement of the outer and inner camshafts, the cam phase change unit is coupled to an end portion of the shaft member and causes the relative displacement of the outer and inner camshafts, the cam lobe has a hold section that permits the assembled camshaft to be held in an orientation, and when the assembled camshaft is held in the orientation by using the hold section in order to couple the cam phase change unit to the end portion of the shaft member, the connecting member performs a function to prevent rotation of the inner camshaft.

8. The variable valve actuation device according to claim 7, wherein the hold section is provided on the boss.

9. The variable valve actuation device according to claim 8, wherein the hold section is constituted by at least one pair of flat surfaces formed on an outer periphery of the boss and permitting the boss to be clamped.

10. The variable valve actuation device according to claim 8, wherein:

the connecting member is a pin member inserted diametrically into the shaft member and penetrating through the boss and the outer and inner camshafts to connect the cam lobe and the inner camshaft to each other, diametrically opposite portions of the outer periphery of the boss where a through hole for the pin member opens have flat seating surfaces respectively surrounding open ends of the through hole through which the pin member is inserted, and the hold section is constituted by the seating surface of the boss.

11. The variable valve actuation device according to claim 1, wherein:

the shaft member is rotatably arranged above the cylinder, the first and second cams are arranged adjacent to each other above the cylinder, and at least part of a shaft section located between the adjacent first and second cams is used as a journal rotatably supported above the cylinder.

* * * * *